United States Patent [19]

Bowen

[11] Patent Number: 4,514,977

[45] Date of Patent: May 7, 1985

[54] WATER LIFT SYSTEM

[76] Inventor: Collin W. Bowen, 1105 Ada St., Durant, Okla. 74701

[21] Appl. No.: 449,509

[22] Filed: Dec. 13, 1982

Related U.S. Application Data

[63] Continuation-in-part of Ser. No. 303,692, Sep. 21, 1981, abandoned, which is a continuation of Ser. No. 88,955, Oct. 29, 1979, abandoned.

[51] Int. Cl.[3] ..... F04F 10/00

[52] U.S. Cl. ..... 60/398; 417/148

[58] Field of Search ..... 60/325, 398, 721; 417/138, 148; 137/205

[56] References Cited

U.S. PATENT DOCUMENTS 340,343 4/1886 Mills ..... 60/325

746,242 12/1903 Baggaley ..... 60/398

FOREIGN PATENT DOCUMENTS 46-40972 12/1971 Japan ..... 417/138

*Primary Examiner*—Stephen F. Husar

*Attorney, Agent, or Firm*—Head, Johnson & Stevenson

[57] ABSTRACT

A vacuum pump attached to the top of an enclosed tank situated above a lower liquid level is utilized sequentially to draw liquid from the lower level into the tank and thereafter drain the tank to a useful purpose including a low head turbine generator, irrigation, storage and other useful purposes.

2 Claims, 1 Drawing Figure

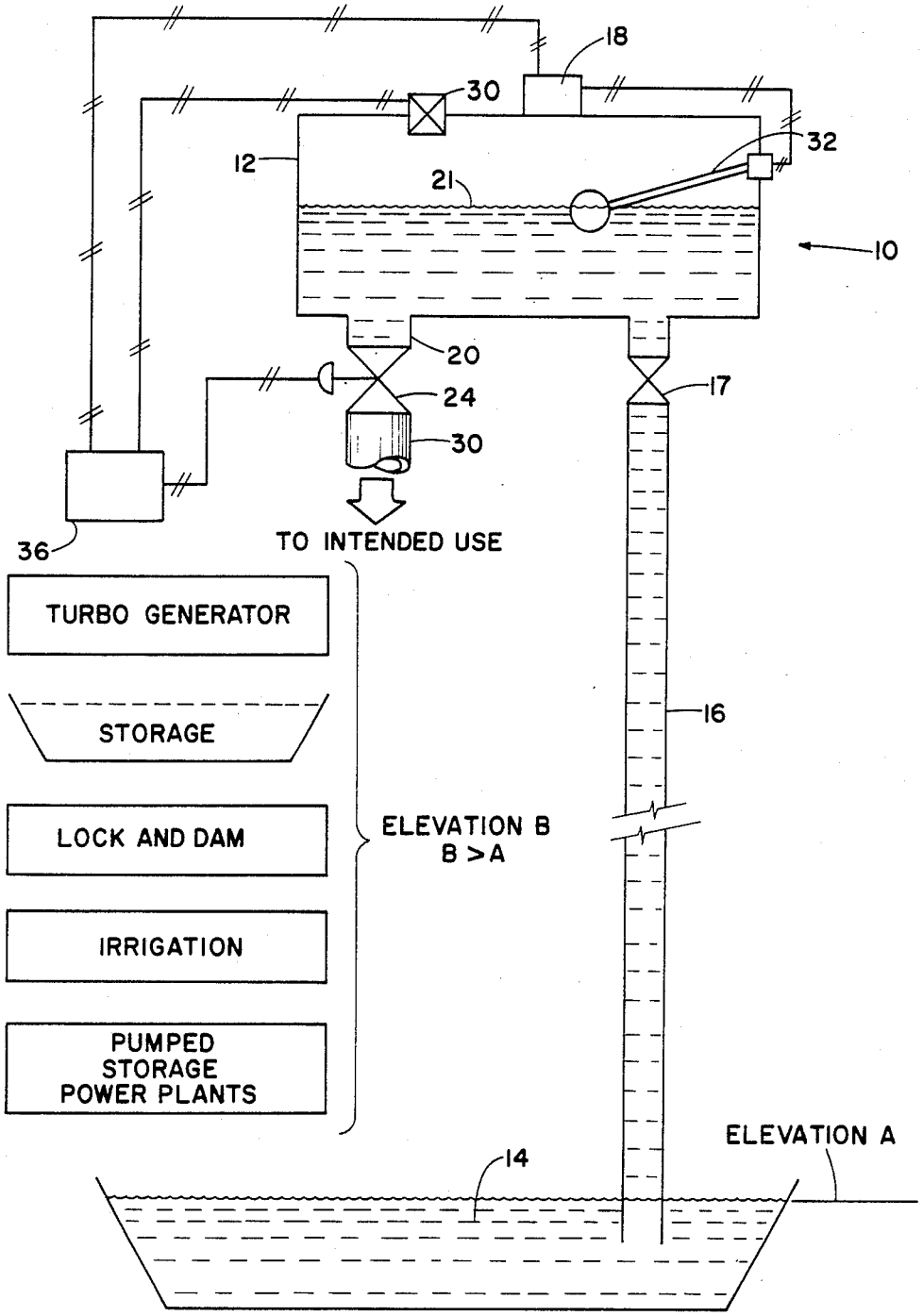
18
30
32
12
21
10
20
24
17
30
36
TO INTENDED USE
TURBO GENERATOR
STORAGE
16
LOCK AND DAM
ELEVATION B
B > A
IRRIGATION
PUMPED
STORAGE
POWER PLANTS
ELEVATION A
14

WATER LIFT SYSTEM

CROSS-REFERENCE TO RELATED APPLICATION

This is a continuation in part application of Ser. No. 303,692, filed Sept. 21, 1981, entitled "BUOYANT PUMP", now abandoned, which is a continuation application of Ser. No. 88,955, filed Oct. 29, 1979, entitled "BUOYANT PUMP", now abandoned.

BACKGROUND OF THE INVENTION

1. Field of the Invention

The present invention relates to an apparatus which lifts liquids from a first level to a higher second level, and more particularly, such a device which utilizes atmospheric pressure on the surface of a liquid to be raised.

2. Description of the Prior Art

Numerous electrical pump systems have been devised which lift a liquid from a first lower level to a higher second level. These prior art systems usually consume large amounts of electrical energy. To reduce the consumption of electrical energy, various systems have been designed which utilize atmospheric pressure on the surface of the liquid to be raised, such as an ordinary water lift pump. Ordinary water lift pumps are not capable of lifting a body of water greater than 10–15 vertical feet above the lower level. There appears to be no prior art pumps which can combine the lifting capability of a normal electrically powered pump and the low energy consumption of an atmospheric water lift pump.

The need for an efficient low cost water lift system exists, as for example, when a political state seeks to transfer water in stages from a lower elevational water supply area to an arid higher elevational area.

SUMMARY OF THE INVENTION

It is an object of this invention to provide a water lift system that uses a vacuum pump assisted by atmospheric pressure which reduces energy consumption when compared to a regular positive displacement type pumping system.

More particularly, the invention is directed to a system and apparatus to create a liquid energy head that includes a vacuum fill tank (VFT) that is disposed above a lower liquid supply. The distance between the VFT and the lower liquid level will range preferrably between 20–25'. The VFT is airtight and includes a vacuum pump connected to the top and also includes an air intake valve also located on the top of the VFT. An inlet concuit extends from below the level of the lower liquid supply into the bottom of the VFT. A check valve or means to unidirectionally control the flow of liquid into the VFT is provided, so as to prevent flow from the VFT back into the lower liquid supply. An outlet is provided in the bottom of the VFT along with a discharge valve to control the flow of liquid therethrough to the intended use. An automatic sequential control is provided to initiate and maintain operation of the system. This includes means to close the discharge valve and the air intake valve and initiate the vacuum pump. Means such as a liquid level control within the VFT is provided to stop the pump upon a given level or other condition in the VFT. Thereafter the sequential control will open the discharge valve and the air intake valve substantially simultaneously and thereby permit the directing of the discharging liquid to a useful purpose as set forth herein.

BRIEF DESCRIPTION OF THE DRAWINGS

FIG. 1 is a semi-diagrammatic view of an apparatus embodying the present invention:

DETAILED DESCRIPTION OF THE PREFERRED EMBODIMENT

Before explaining the present invention in detail, it is to be understood that the invention is not limited in its application to the details of the construction and arrangement of parts illustrated in the accompany drawings. The invention is capable of other embodiments and of being practiced or carried out in a variety of ways. It is to be understood that the phraseology and terminology employed herein is for the purpose of description and not of limitation.

Referring to the drawing in detail, reference character 10 generally indicates an apparatus to lift liquids from a lower level to a higher level utilizing atmospheric pressure. As shown in FIG. 1, an airtight vacuum fill-tank 12 (referred to herein as "VFT") is disposed above a body of liquid 14, such as water. A conduit 16 extends from within the water 14 upwards and opens into the lower portion of the tank 12. A check valve 17 allowing flow only in the direction indicated is a part of conduit 16 and is positioned immediately below VFT 12. The vertical distance between the tank 12 and the water 14 may vary depending upon the utilization contemplated for the apparatus 10; however, the practical limit of the distance is 20 to 25'. Various factors including ambient temperature and pressure conditions will dictate the height and as further limited by Torricelli's principle. The 20 to 25' range allows for an adequate volume VFT and its discharge outlet. Further only a partial vacuum or extremely low air pressure would be required. A vacuum pump 18, such as a rotary-type or ring-type is mounted on the top portion of the tank 12 and is in communication with the interior of the rank 12. A discharge conduit 20 extends downward from the lower bottom portion of the VFT 12. A valve means 24, operated automatically, is mounted to the conduit 20, the operation thereof will be described in more detail hereinbelow.

A conduit 30 extends downward from the valve 24 for the intended use, such as:

(1) For generating electricity with a low-head turbine;
(2) For use in pumped storage power plants;
(3) For use in converting outlet conduits in present dams and lakes for purposes one and two above (a low water dam below original dam would be necessary).
(4) For irrigation projects;
(5) For use in water storage projects; and
(6) For use in water transfer projects utilizing canals and locks.

Furthermore, the apparatus includes a quick opening pressure equalization valve 30 connected to the top of VFT 12. A liquid level control 32, e.g. float is used in the operation as hereinafter described. An automatic sequential control 36 is utilized in the process to activate and de-activate the various valves and controls previously described including valve 17.

In operation, the auto-sequential control 36 is activated. Initial start-up is described with VFT 12 empty, valves 24 and 17 closed and valve 30 closed. Vacuum pump 18 is started and valve 17 opened or if a check valve will automatically open which draws air from VFT 12, lowering the pressure therein, which in turn draws the water 14 upward within conduit 16 into the tank 12. As the liquid level in the VFT 12 rises, there is some compression of the air remaining in the VFT increasing the efficiency of the vacuum pump 18. The compressive action allows the vacuum pump to remove greater quantities of air. The automatic level control 32 is disposed within the tank 12 and is in electrical communication with the vacuum pump 18. The level control 32 starts the vacuum pump 18 when the liquid 21, within the tank 12, falls to a predetermined level and stops the vacuum pump 18 when the liquid 21 rises to a specified level. During fill of VFT 12 valve 24 is closed. When the desired level is reached and vacuum pump 18 stopped, the automatic sequential controller 36 simultaneously opens valves 24 and 30 (valve 17 being held closed) and the liquid permitted to drain from VFT 12 preferrably at about the same time or less required to fill it. This may require a large opening conduit 20, and for example a slide gate type valve 24. Once drained, valves 24 and 30 are closed, vacuum pump 18 started, valve 17 opened and the process repeated.

The advantage of the device is to take advantage of the atmospheric pressure energy plus vacuum pump 18 to provide an economical system to raise liquids by pumping air to lift a large volume of water.

The range of heights to which liquids could be lifted can also be extended by using a series of pumps "stair-stepped" or "stacked" up the side of a hill, dam, or other structure.

What is claimed is:

1. An apparatus to create a liquid energy head at an elevational B, comprising:

a vacuum fill-tank (VFT) disposed above a liquid supply at elevation A, wherein B is higher than A and no greater that about 30';

a vacuum pump mounted on the top of said VFT;

an air intake valve located at the top of said VFT;

an inlet conduit extending from below the level of said lower liquid supply to said vacuum fill-tank;

a unidirectional valve in said conduit to allow flow into said VFT and prevent flow back into the lower liquid supply;

and outlet from said VFT, and a discharge valve means to control the flow of liquid through said outlet;

means to sequentially initiate operation of said system, including means to close said discharge valve and said air intake valve, and initiate said vacuum pump, means to stop said pump upon a given condition in said VFT, means while said pump is stopped thereafter to open said discharge valve and said air intake valve; and directing said discharging liquid to a useful purpose.

2. An apparatus of claim 1 wherein said useful purpose is a low hydrostatic head turbine electrical generator.

* * * * *